US006672073B2

(12) United States Patent
Wiebe

(10) Patent No.: US 6,672,073 B2
(45) Date of Patent: Jan. 6, 2004

(54) SYSTEM AND METHOD FOR SUPPORTING FUEL NOZZLES IN A GAS TURBINE COMBUSTOR UTILIZING A SUPPORT PLATE

(75) Inventor: David J. Wiebe, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 15 days.

(21) Appl. No.: 10/152,517

(22) Filed: May 22, 2002

(65) Prior Publication Data

US 2003/0217556 A1 Nov. 27, 2003

(51) Int. Cl.[7] ..... F02C 3/00; F23R 3/14
(52) U.S. Cl. ..... 60/796; 60/747; 60/748
(58) Field of Search ..... 60/796, 800, 737, 60/746, 747, 748, 740

(56) References Cited

U.S. PATENT DOCUMENTS

| | | | | |
|---|---|---|---|---|
| 3,657,883 A | | 4/1972 | De Corso | 60/39.37 |
| 4,408,461 A | * | 10/1983 | Bruhwiler et al. | 60/747 |
| 4,413,470 A | * | 11/1983 | Scheihing et al. | 60/800 |
| 4,525,996 A | | 7/1985 | Wright et al. | 60/39.31 |
| 5,117,624 A | | 6/1992 | Roberts, Jr. et al. | 60/39.32 |
| 5,121,597 A | | 6/1992 | Urushidani et al. | 60/39.06 |
| 5,259,184 A | * | 11/1993 | Borkowicz et al. | 60/737 |
| 5,274,991 A | | 1/1994 | Fitts | 60/39.32 |
| 5,357,745 A | * | 10/1994 | Probert | 60/747 |
| 5,419,115 A | | 5/1995 | Butler et al. | 60/39.36 |
| 5,463,864 A | | 11/1995 | Butler et al. | 60/39.31 |
| 5,577,379 A | | 11/1996 | Johnson | 60/39.31 |
| 5,924,275 A | * | 7/1999 | Cohen et al. | 60/747 |
| 6,026,645 A | | 2/2000 | Stokes et al. | 60/737 |
| 6,209,326 B1 | | 4/2001 | Mandai et al. | 60/748 |
| 6,282,904 B1 | | 9/2001 | Kraft et al. | 60/739 |
| 6,415,610 B1 | * | 7/2002 | Parker | 60/798 |

* cited by examiner

*Primary Examiner*—Ted Kim

(57) ABSTRACT

A system for supporting a plurality of fuel nozzles in a combustor includes a plurality of fuel nozzles coupled to a fuel nozzle support housing proximate an upstream end of each fuel nozzle, a plurality of swirler vanes rigidly coupled to respective fuel nozzles proximate an intermediate portion of the fuel nozzle, a plurality of shrouds rigidly coupled to respective swirler vanes, each shroud having an upstream end adjacent the intermediate portion of the fuel nozzle and a downstream end and a support plate rigidly coupled to the plurality of shrouds proximate an intermediate portion of each of the shrouds. The support plate has a perimeter approximately equal to an inside perimeter of combustor housing which allow the support plate to limit the movement and vibration of the fuel nozzles.

10 Claims, 4 Drawing Sheets

SYSTEM AND METHOD FOR SUPPORTING FUEL NOZZLES IN A GAS TURBINE COMBUSTOR UTILIZING A SUPPORT PLATE

TECHNICAL FIELD OF THE INVENTION

The present invention relates generally to the field of gas turbine combustors and, more particularly, to a system and method for supporting fuel nozzles in a gas turbine combustor utilizing a support plate.

BACKGROUND OF THE INVENTION

A gas turbine combustor has an-associated fuel nozzle assembly. The fuel nozzle assembly typically includes a number of fuel nozzles cantilevered off of a fuel nozzle supporting housing. Each fuel nozzle has an associated swirler vane and shroud that facilitates the mixing of air with fuel from the fuel nozzle before entering the combustor.

The shrouds of the fuel nozzles need to fit within holes in a baseplate of the combustor housing in a manner that prevents large gaps between the shrouds and the baseplate. However, because there are typically a number of fuel nozzles that need to be installed and since the fuel nozzle assembly is installed as a single unit within the combustor housing (i.e., a blind assembly), there is usually not a good fit between the ends of the shrouds and the holes in the baseplate. The baseplate provides minimal support to the ends of the fuel nozzles. This causes each individual fuel nozzle to be susceptible to side-to-side vibration. Vibration of fuel nozzles in a gas turbine combustor is detrimental because it increases the likelihood of failure in addition to decreasing the life of the fuel nozzles.

SUMMARY OF THE INVENTION

According to an embodiment of the invention, a fuel nozzle assembly includes a plurality of fuel nozzles coupled to a fuel nozzle support housing proximate an upstream end of each fuel nozzle, a plurality of swirler vanes rigidly coupled to respective fuel nozzles proximate an intermediate portion of the fuel nozzle, a plurality of shrouds rigidly coupled to respective swirler vanes, each shroud having an upstream end adjacent the intermediate portion of the fuel nozzle and a downstream end, and a support plate rigidly coupled to the plurality of shrouds proximate an intermediate portion of each of the shrouds. The support plate has a perimeter approximately equal to an inside perimeter of a housing of a combustor.

Embodiments of the invention provide a number of technical advantages. The invention may include all, some, or none of these advantages. The invention provides a support plate that couples a plurality of fuel nozzles together and structural support in such a manner that minimizes detrimental vibration of the fuel nozzles. Without this structural support each fuel nozzle would be basically cantilevered off the support housing. The fuel nozzles would receive some support from the engagement of the shroud into the baseplate but this support would be minimal because the baseplate is not a rigid structure. Each fuel nozzle's fundamental mode of vibration is elevated to a higher natural frequency, significantly stiffening each fuel nozzle with the present invention helps support and dampens that vibration so that more energy is required to excite each fuel nozzle. The fuel nozzle support base plate helps to align during assembly and operation the fuel nozzles within the combustor housing of a gas turbine combustor as well as to facilitate alignment between the fuel nozzle shrouds and combustor housing baseplate. This helps to prevent loss of cooling air, heat distortion, and potential vortices.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF EXAMPLE EMBODIMENTS OF THE INVENTION

Example embodiments of the present invention and their advantages are best understood by referring now to FIGS. 1 through 6B of the drawings, in which like numerals refer to like parts.

Figure 1A:
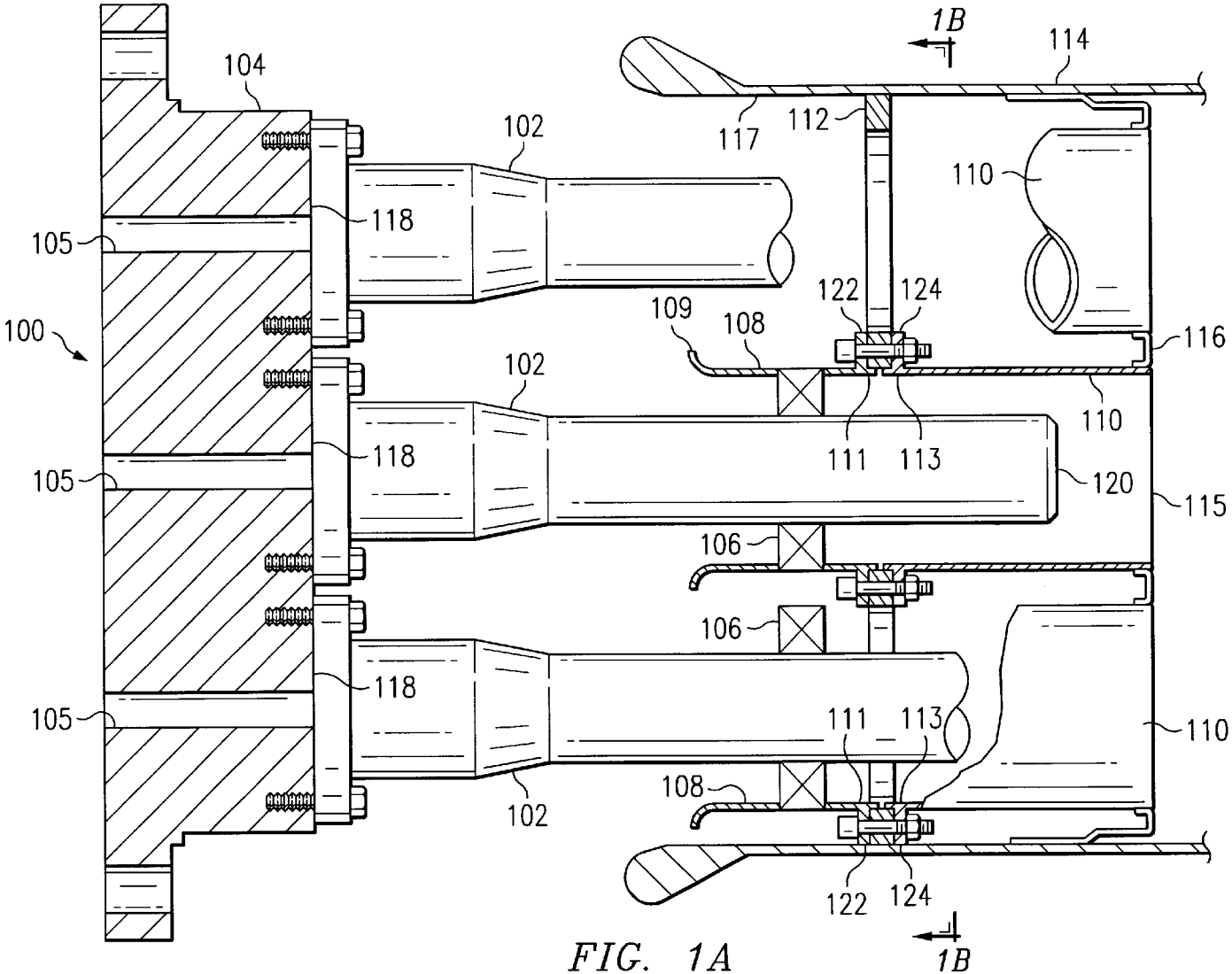
FIG. 1A is a cross-sectional side view.
Figure 1B:
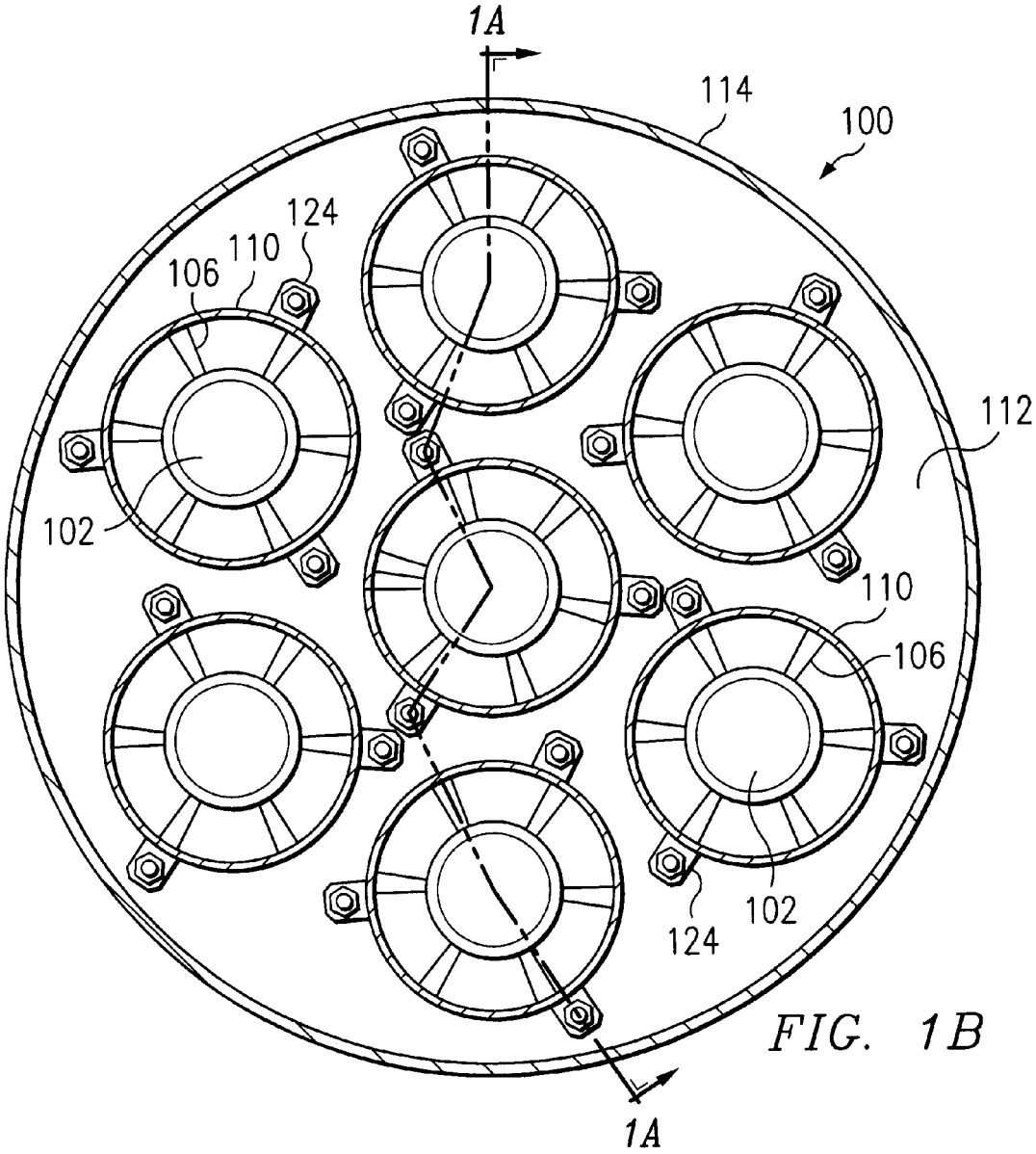
FIG. 1B is a cross-sectional end view, of a system for supporting fuel nozzles in a gas turbine combustor according to one embodiment of the present invention.

FIG. 1A is a cross-sectional side view, and FIG. 1B is a cross-sectional end view, of a system 100 for supporting a plurality of fuel nozzles 102 in a gas turbine combustor according to one embodiment of the present invention. System 100 is particularly suitable for dry low nitrogen oxide combustors; however, system 100 may be suitable for any type of gas turbine combustor. In the illustrated embodiment system 100 includes fuel nozzles 102 coupled to a fuel nozzle supporting housing 104, a plurality of swirler vanes 106 coupled to respective fuel nozzles 102, a plurality of fore shrouds 108 coupled to respective swirler vanes 106, a plurality of aft shrouds 110 coupled to respective fore shrouds 108, a support plate 112, a combustor housing 114, and a combustor housing baseplate 116. Unless otherwise noted in the following detailed description, all components of system 100 may be formed from any suitable material, such as from a nickel alloy, a steel alloy, or other material.

Fuel nozzles 102 may be any suitable fuel nozzles that are utilized in gas turbine combustors. In the illustrated embodiment, seven fuel nozzles are shown; however, any suitable number of fuel nozzles may be employed. Each fuel nozzle 102 has an upstream end 118, a downstream end 120, and an intermediate portion therebetween. Each fuel nozzle 102 is coupled to fuel nozzle support housing 104 at upstream end 118 via any suitable method, such as bolting or welding. Generally, fuel nozzles 102 accept fuel at upstream end 118 and inject the fuel into the combustor at or near downstream end 120. Fuel may also be injected at or near swirler vanes 106. Fuel nozzles 102 are generally circular in shape; however, fuel nozzles 102 may be other suitable shapes.

Fuel nozzle support housing 104 delivers the fuel to fuel nozzles 102 via conduits 105 formed in fuel nozzle support housing 104. Fuel nozzle support housing 104 is generally circular in shape; however, fuel nozzle support housing 104 may be other suitable shapes.

Swirler vanes 106 are coupled to respective fuel nozzles 102 proximate the intermediate portions of fuel nozzles 102. Swirler vanes 106 may be rigidly coupled to fuel nozzles 102 in any suitable manner, such as welding. In a particular embodiment, swirler vanes 106 are integral with fuel nozzles 102. In some embodiments, swirler vanes 106 facilitate the generating of air turbulence traveling through fore shrouds 108 and aft shrouds 110 before the air mixes with fuel being injected by fuel nozzles 102. In other embodiments, fuel may be injected through swirler vanes 106. As illustrated in FIG. 1B, swirler vanes 106 are generally circular in shape; however, swirler vanes may have other suitable shapes.

Fore shrouds 108 have an upstream end 109, a downstream end 111, and an intermediate portion therebetween that is rigidly coupled to respective swirler vanes 106. Fore shrouds 108 may be rigidly coupled to swirler vanes 106 in any suitable manner, such as welding. In a particular embodiment, fore shrouds 108 are integral with swirler vanes 106. Fore shrouds 108 may also include a flange 122 adjacent downstream end 111 for the purpose of coupling to support plate 112 and aft shrouds 110, as described in more detail below. In one embodiment, there are three flanges 122 equally distributed around a perimeter of each fore shroud 108; however, there may be any number of suitable flanges 122 having any suitable spacing associated with each fore shroud 108. Fore shrouds 108 are generally circular in shape; however, other suitable shapes may be utilized.

Aft shrouds 110 have an upstream end 113 and a downstream end 115 and an intermediate portion therebetween. Aft shrouds 110 are rigidly coupled to fore shrouds 108 in any suitable manner, such as by bolting as illustrated in FIG. 1A. Aft shrouds 110 may have a flange 124 to allow the coupling of aft shrouds 110 to fore shrouds 108. In one embodiment, there are three flanges 124 equally distributed around a perimeter of each aft shroud 110 (FIG. 1B); however, there may be any number of suitable flanges 124 having any suitable spacing associated with each aft shroud 110. Similar to fore shrouds 108, aft shrouds 110 are generally circular in shape; however, other suitable shapes may be utilized. Downstream end 115 of aft shrouds 110 engage combustor housing baseplate 116, as described in more detail below.

Support plate 112, according to the teachings of the present invention, couples fuel nozzles 102 together at their intermediate portions to provide structural support to fuel nozzles 102 in such a manner that minimizes detrimental vibration of fuel nozzles 102. Vibration may still be present; however, its amplitude is greatly reduced by support plate 112. This rigid support at the intermediate portions of fuel nozzles 102 elevates each fuel nozzle's 102 fundamental mode of vibration to a higher natural frequency, which significantly stiffens each fuel nozzle 102 so that more energy is required to excite each fuel nozzle 102. Support plate 112 helps to align fuel nozzles 102 within combustor housing 114 both during assembly and in operation. The details of support plate 112 are described below in conjunction with FIG. 2. In general, support plate 112 couples to fore shrouds 108 and aft shrouds 110 using flanges 122 and 124. Fore shrouds 108 and aft shrouds 110 are rigidly coupled to swirler vanes 106, which are rigidly coupled to fuel nozzles 102 at an intermediate portion thereof. Support plate 112 fits snugly within combustor housing 114 to provide its support. This is described in more detail below.

Combustor housing 114 defines a main combustion zone for the gas turbine combustor. Combustor housing 114 is generally circular in shape; however, combustor housing 114 may have other suitable shapes. In addition, combustor housing may be formed with any suitable wall thickness.

Combustor housing baseplate 116 is coupled to combustor housing 114 in any suitable manner, such as welding or brazing. In a particular embodiment, combustor housing baseplate 116 is not coupled to combustor housing 114, but engages combustor housing 114 with a sliding fit, as described in further detail below in conjunction with FIG. 5. Combustor housing baseplate 116 has a plurality of holes formed therein in order to accept downstream ends 115 of aft shrouds 110.

Figure 2A:
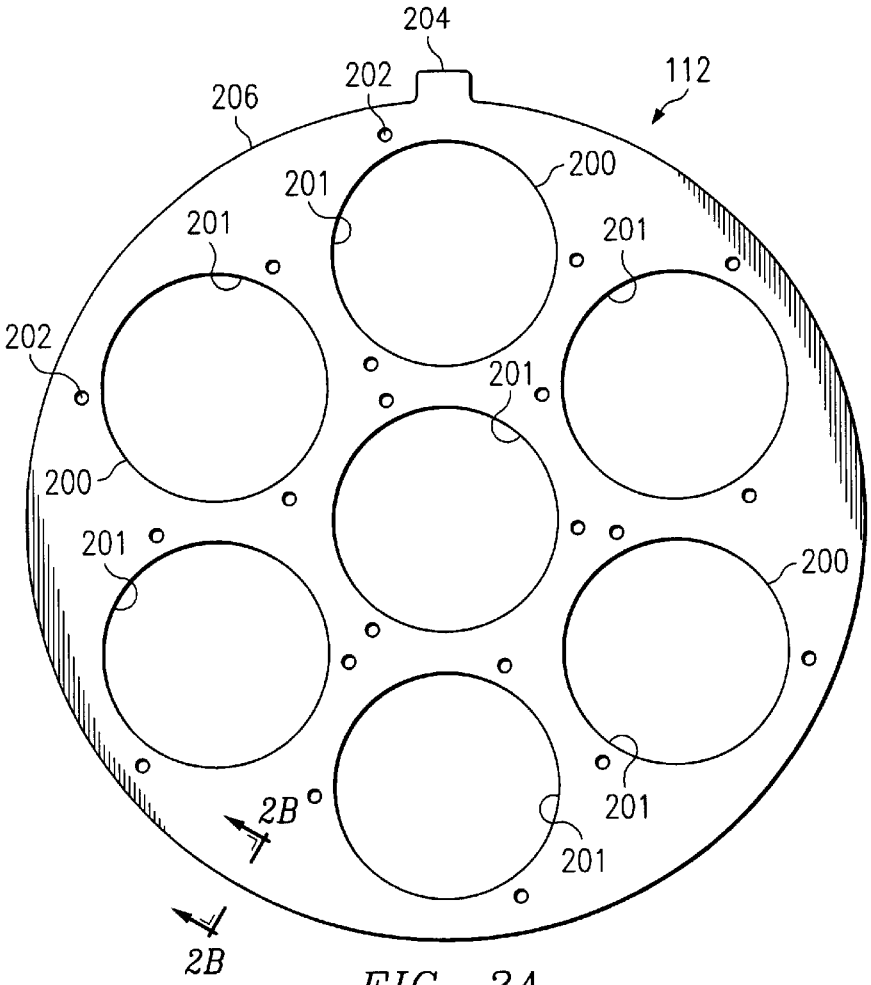
FIG. 2A is a plan view, and FIG. 2B an edge cross-sectional view, of one embodiment of a support plate used in the system of FIGS. 1A and 1B.

FIG. 2A is a downstream view of one embodiment of support plate 112 of the present invention. As illustrated, support plate 112 has a plurality of shroud openings 200, a plurality of bolt holes 202, and a radial protuberance 204. Support plate 112 is illustrated in FIG. 2A to be generally circular in shape; however, other suitable shapes may be utilized. The shape of support plate 112 conforms to the general shape of combustor housing 114 so that a relatively snug fit may be maintained between a perimeter 206 of support plate 112 and an inside perimeter of combustor housing 114. In one embodiment, support plate 112 is generally circular in shape and has a circumference that is substantially equal to a circumference of an inside of combustor housing 114. Support plate 112 may have any suitable thickness; however, in one embodiment, the thickness is between ¼ inch and ½ inch.

Shroud openings 200 function to accept fore shrouds 108 and aft shrouds 110. As illustrated, shroud openings 200 have an edge 201 that are adapted to engage an outside surface of fore shrouds 108 and aft shrouds 110. Hence, shroud openings 200 have a shape that matches up with an outside surface of fore shrouds 108 and aft shrouds 110. Generally, shroud openings 200 have a circular shape; however, any suitable shape may be utilized.

In an embodiment where support plate 112 is fastened to fore shrouds 108 and aft shrouds 110 by bolts, support plate 112 has bolt holes 202 formed therein in a location to match up with respective holes formed in flanges 122 and flanges 124. A diameter of bolt holes 202 and respective holes formed in flanges 122 and flanges 124 are determined such that a rigid connection may be accomplished. In an embodiment where support plate 112 is coupled to fore shrouds 108 and aft shrouds 110 by welding, support plate 112 will not have bolt holes 202 formed therein.

Radial protuberance 204, which is optional, is described in more detail below in conjunction with FIGS. 6A and 6B. In general, radial protuberance 204 is formed on perimeter 206 of support plate 112 to facilitate the alignment of fuel nozzles 102 when being inserted into combustor housing 114. Radial protuberance 204 may have any suitable dimensions and may be formed on perimeter 206 in any suitable location.

Figure 2B:
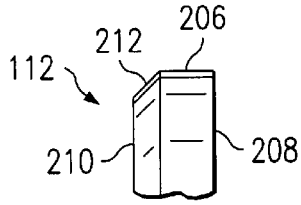

As illustrated in FIG. 2B, support plate 112 has an upstream side 208 and a downstream side 210. A chamfer 212 is formed around perimeter 206 of support plate 112 adjacent downstream side 210 to facilitate the insertion of support plate 112 in combustor housing 114. Chamfer 212 may have any suitable dimensions and any suitable contour.

Figure 3:
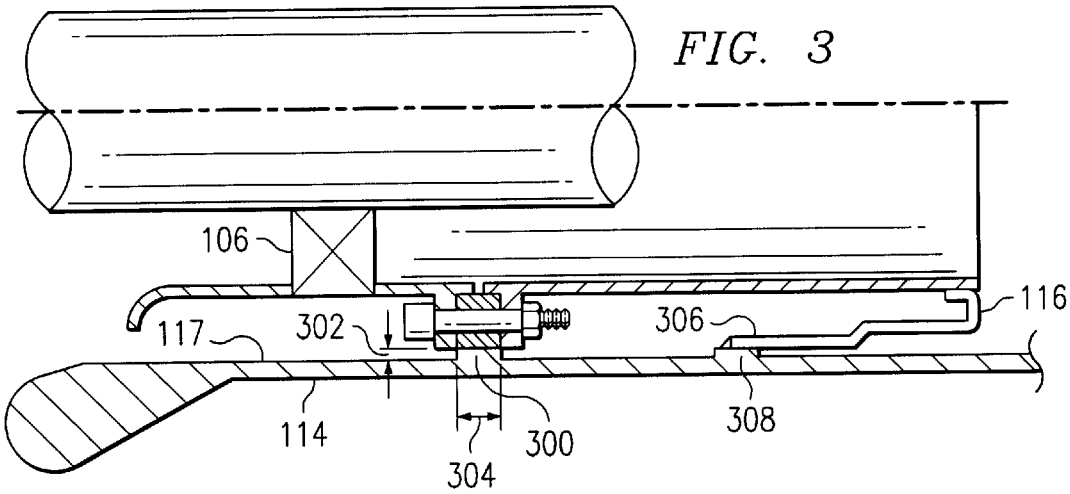
FIG. 3 is a partial cross-sectional view of the system of FIG. 1A and 1B illustrating the system in more detail.

To ensure that a snug fit is obtained between perimeter 206 of support plate 212 and an inside 117 of combustor housing 114, inside 117 of combustor housing 114 may have a raised seating surface 300 formed thereon, as shown in FIG. 3. A height 302 of raised seating surface 300 may have any suitable dimension. For example, height 302 may be anywhere from 0.030 inches to 0.070 inches. In general, height 302 is determined by the inside diameter of combustor housing 114 and the outside diameter of support plate 112 they are both circular in shape. A width 304 of raised seating surface 300 is generally wider than the thickness of support plate 112; however, width 304 may have any suitable dimension. Again, raised seating surface 300 provides for a snug fit of support plate 112 within combustor housing 114.

Also illustrated more clearly in FIG. 3 is combustor housing baseplate 116 brazed to combustor 114 via a leg 306 of combustor housing baseplate 116. Leg 306 may be any suitable length. Inside 117 of combustor housing 114 may have another raised seating surface 308 formed thereon to ensure that a snug fit is obtained between combustor housing baseplate 116 and inside 117 of combustor housing 114. Raised seating surface 308 may have any suitable height or width.

Figure 4:
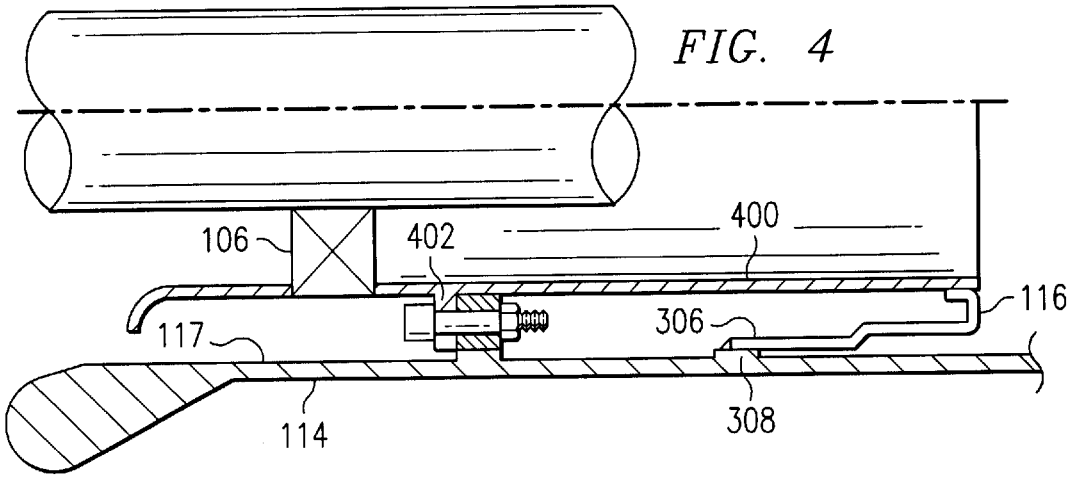
FIG. 4 is a partial cross-sectional view of the system of FIGS. 1A and 1B illustrating an additional embodiment of the system.

FIG. 4 is a partial cross-sectional view of system 100 illustrating an additional embodiment of system 100. In this embodiment, fore shroud 108 and aft shroud 110 are combined into a single shroud 400 having a single flange 402 to facilitate the coupling of support plate 112. Shroud 400 may be coupled to swirler vane 106 in any suitable manner, such as welding. In a particular embodiment, shroud 400 is formed integral with swirler vanes 106.

Figure 5:
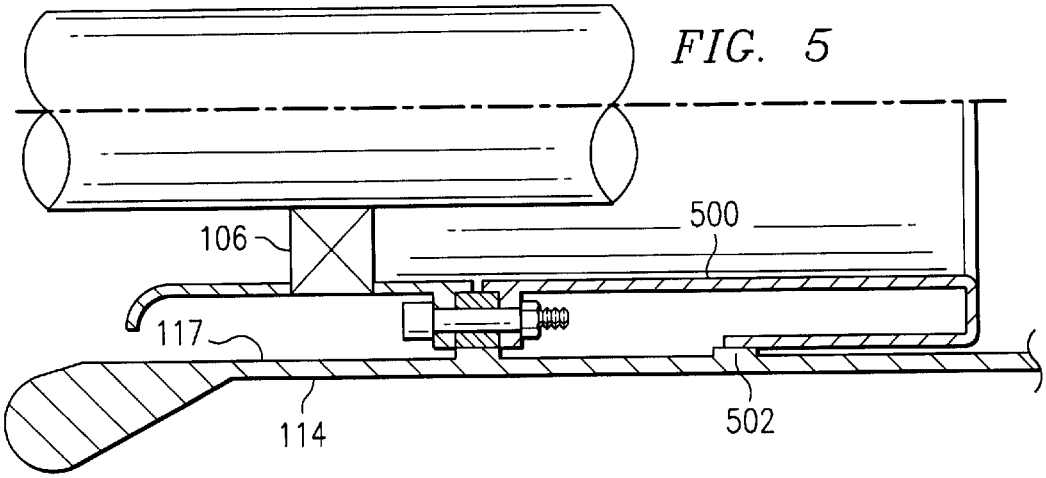
FIG. 5 is a partial cross-sectional view of the system of FIGS. 1A and 1B illustrating an additional embodiment of the system.

FIG. 5 is a partial cross-sectional view of system 100 illustrating an additional embodiment of the invention. In this embodiment, aft shroud 110 and combustor housing baseplate 116 are formed integral to one another to form an aft shroud 500. Because of the sliding fit 502 of shroud 500 within combustor housing 114, this embodiment aids in angular alignment of fuel nozzles 102 within combustor housing 114. For example, radial protuberance 204 (FIG. 2A) may not be needed in this embodiment because there is much less concern about matching up aft shrouds 110 with the holes formed in combustor housing baseplate 116.

Figure 6A:
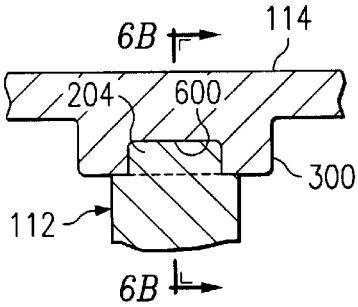
FIG. 6A is a cross-sectional side view.
Figure 6B:
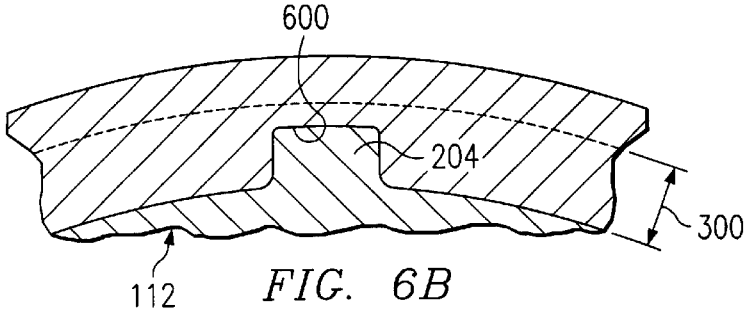
FIG. 6B is a cross-sectional end view, illustrating one embodiment of aligning a support plate with a combustor housing.

FIG. 6A is a side cross-sectional view, and FIG. 6B is an end cross-sectional view illustrating an alignment of support plate 112 within combustor housing 114 according to one embodiment of the present invention. As illustrated in FIGS. 6A and 6B, combustor housing 114 has seating surface 300 formed therein and seating surface 300 has a depression 600 formed therein to accept radial protuberance 204 of support plate 112 when support plate 112 is disposed in combustor housing 114. Radial protuberance 204 engaged with depression 600 helps to align aft shrouds 110 to holes formed in combustor housing baseplate 116 so that a relatively tight fit may be obtained between aft shrouds 110 and combustor housing baseplate 116. This may allow tighter tolerances and, therefore, avoid any excessive gaps between aft shrouds 110 and combustor housing baseplate 116, which further provides support to fuel nozzles 102.

By providing the support plate 112 of the present invention the advantage in supporting the fuel nozzles 102 and shrouds 110 are many and include; assuring the fuel nozzles will be maintained in the correct precise position in the combustor; prevents the fuel nozzles 102 from lateral vibration; provides structural support for the fuel nozzles 102 and shroud; and assures that during assembly the fuel nozzles 102 are placed in the correct position initially.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A support system for a fuel nozzle assembly, in a combustor having a combustor housing; a fuel nozzle support housing; a plurality of fuel nozzles coupled to the fuel nozzle support housing proximate an upstream end of each fuel nozzle; a plurality of swirler vanes, each swirler vane rigidly coupled to a respective fuel nozzle proximate an intermediate portion of the fuel nozzle; a plurality of shrouds, each shroud rigidly coupled to a respective swirler vane, each shroud having an upstream end adjacent the intermediate portion of the fuel nozzle and a downstream end, further comprising:

a support plate having a perimeter approximately equal to an inside perimeter of the combustor housing located in the combustor housing wherein the fuel nozzles are rigidly attached to the support plate thereby holding the fuel nozzles in rigid position in the combustor.

2. The system of claim 1, wherein the support plate has a plurality of generally circular holes formed therein and the fuel nozzles are positioned therethrough.

3. The system of claim 2, wherein each fuel nozzle is rigidly coupled to a fuel nozzle support housing with a fastener selected from the group consisting of a bolt and a weld, wherein the fuel nozzles, the swirler vanes, and the shrouds are formed integral with each other and the fuel nozzle support shrouds being rigidly attached to the support plate.

4. The system of claim 2, wherein the perimeter edge of the support plate includes a radial protuberance formed thereon, the radial protuberance operable to engage a depression on an inside of the housing of the combustor to align the support plate and fuel nozzles in the combustor housing.

5. The system of claim 1, wherein the support plate has an upstream side and a downstream side, the downstream side having a chamfer formed around the perimeter of the support plate.

6. A support system for a combustor for a turbine engine fuel nozzle assembly, the combustor having: a fuel nozzle support housing; a plurality of fuel nozzles coupled to the fuel nozzle support housing proximate an upstream end of each fuel nozzle; a plurality of swirler vanes, each swirler vane rigidly coupled to a respective fuel nozzle proximate an intermediate portion of the fuel nozzle; a plurality of circular fore shrouds, each fore shroud rigidly coupled to a respective swirler vane, each fore shroud having an upstream end adjacent the intermediate portion of the fuel nozzle and a downstream end; a plurality of circular aft shrouds, each aft shroud having an upstream end coupled to the downstream end of a respective fore shroud, each aft shroud having a downstream end; a combustor housing baseplate having a plurality of circular holes formed therein, the circular holes adapted to accept the downstream ends of the aft shrouds; a circular combustor housing coupled to the combustor housing baseplate; the support system comprising:

a circular support plate rigidly coupled to the downstream ends of the plurality of fore shrouds and the upstream ends of the plurality of aft shrouds, the support plate having a circumference approximately equal to an inside circumference of the combustor housing.

7. The system of claim 6, wherein each fuel nozzle is rigidly coupled to the fuel nozzle support housing;

wherein the support plate has a plurality of generally circular holes formed therein for passing the fuel nozzle there through.

8. The system of claim 6, wherein the fuel nozzles, the swirler vanes, and the fore shrouds are formed integral with each other, and the aft shrouds and the combustor housing baseplate are formed integral with each other, and the support plate is attached to flanges on the downstream ends of the plurality of fore shrouds and to flanges on the upstream ends of the plurality of aft shrouds.

9. The system of claim 6, wherein the support plate has an upstream side and a downstream side, the downstream side having a chamfer formed around the circumference of the support plate.

10. The system of claim 6, wherein the circumferential edge of the support plate includes a radial protuberance formed thereon operable to engage a depression formed on an inside of the combustor housing to align the fuel nozzles in the combustor housing.

* * * * *